US006394500B1

(12) United States Patent
Nixon et al.

(10) Patent No.: US 6,394,500 B1
(45) Date of Patent: May 28, 2002

(54) TUCK LABEL EASY OPENING PULL TAB

(75) Inventors: Tracy Nixon, Bellbrook; Patrick A. Konkol, Troy, both of OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/804,879

(22) Filed: Mar. 13, 2001

(51) Int. Cl.[7] ..... B42D 15/00

(52) U.S. Cl. ..... 283/101; 229/68.1; 229/92; 229/313; 229/314; 281/5; 283/62; 283/81; 283/106; 428/42.1; D19/3

(58) Field of Search ..... 281/2, 5; 283/81, 283/61, 62, 101, 105, 106, 116, 117; D19/3; 428/40.1, 41.8, 42.2, 42.3, 43; 229/68.1, 92, 92.1, 92.7, 300, 301, 302, 313, 314, 316

(56) References Cited

U.S. PATENT DOCUMENTS

| | | | | |
|---|---|---|---|---|
| 4,598,935 A | | 7/1986 | Stewart | |
| 4,927,179 A | | 5/1990 | Ehret et al. | |
| 4,955,640 A | | 9/1990 | Anderson | |
| 5,031,939 A | | 7/1991 | Webendorfer et al. | |
| 5,403,636 A | | 4/1995 | Crum | |
| 5,413,383 A | | 5/1995 | Laurash et al. | |
| 5,509,694 A | | 4/1996 | Laurash et al. | |
| 5,630,627 A | | 5/1997 | Stewart | |
| 5,637,369 A | | 6/1997 | Stewart | |
| 5,716,688 A | * | 2/1998 | Burke et al. | 283/101 |
| 5,730,469 A | | 3/1998 | Heimerdinger et al. | |
| 5,735,549 A | | 4/1998 | Konkol et al. | |
| 5,830,550 A | | 11/1998 | Treleaven et al. | |
| 5,837,338 A | * | 11/1998 | Rich et al. | 283/101 |
| 5,975,582 A | | 11/1999 | Treleaven | |
| 6,027,780 A | | 2/2000 | Treleaven et al. | |
| 6,135,506 A | | 10/2000 | Chess et al. | |
| 6,152,357 A | | 11/2000 | Schnitzer | |
| 6,186,554 B1 | * | 2/2001 | Raming | 229/74 |
| 6,213,518 B1 | * | 4/2001 | Raming | 156/1 |

* cited by examiner

*Primary Examiner*—A. L. Wellington
*Assistant Examiner*—Monica S. Carter
(74) *Attorney, Agent, or Firm*—Killworth, Gottman, Hagan & Schaeff, L.L.P.

(57) ABSTRACT

A tuck label for placing on a shipping package. The tuck label includes a substrate portion and a single sheet label portion with adhesive included on a surface. The label portion further includes one or more fold lines that define upper and lower adjacent print panels, both of which can receive printable indicia. A score line is placed in the label portion to define a mount region, a printable surface region and a pull tab region. The pull tab region is disposed between the mount region and the printable surface region, and includes a pull tab with at least one layer of adhesive so that, upon folding of the label portion along the one or more fold lines, the pull tab becomes multi-layered for increased strength and durability. Cut lines that define borders between the three regions become aligned upon such folding, thereby facilitating separability of the pull tab from the remainder of the label portion of the tuck label, as well as subsequent removal of one or more of the printable surface panels along the score line around the printable surface panel periphery.

30 Claims, 8 Drawing Sheets

TUCK LABEL EASY OPENING PULL TAB

BACKGROUND OF THE INVENTION

The present invention generally relates to a printable business form or label that can be adhered to a package, and more particularly to a foldable shipping label that includes ruggedized tear strip features.

The use of shipping labels in the transport of commercial goods is well-known in the art. Typically, such devices include one or more printable surfaces upon which invoice, packing, contents, shipping addresses, receipts and related sundry indicia are placed. The printable surfaces often include a pressure-sensitive adhesive affixed at discrete locations such that the label is removably affixed to a backing sheet. Upon removal from the backing sheet, which is typically a paper liner with a silicone (or similar release material) coating, the label can then be securely fastened to a package to be shipped. One specialized form of shipping label is the folded, or tuck, label, which includes one or more label panels folded underneath another panel, then adhered to a package. By arrangement of one or more folds into a flap-like configuration with perforated peripheries, removal of portions of the label (each possibly including one or more forms of the aforementioned indicia) may be effected even after the label has been adhered to a package. This particular form of shipping label is advantageous because it permits some information to be readily apparent on an outer overlayer panel, while other information remains hidden until the overlayer panel is removed. It additionally permits removal of portions of the information needed by various concerns along the chain of distribution of the package from its point of origin to its final destination.

The traditional approach to facilitating the retrieval of the hidden label panels has been to perforate or score the exposed label surface, such that it tears along a preferred path, thereby providing access to the one or more labels underneath. Additional features to further improve the tearing process have been employed. For example, a pair of parallel perforations can be included to form a "tear strip". Similarly, a tab may be provided at the end of the tear strip to enable a user to employ a simple grasping movement with the fingers. However, these approaches have disadvantages. For example, since most labels use paper and paper-like products as the printable substrate, the perforations may extend in not only with-grain directions, but cross-grain as well. The anisotropic structural characteristics of the substrate become manifest upon an attempted tear, as tears in the with-grain direction tend to be smooth and straight, while those in the cross-grain direction produce jagged, uneven results, potentially compromising the indicia printed thereon. This problem is exacerbated by the single ply thickness of the tabs or tear strips.

To avoid the occurrence of weakened tear strips, other methods have incorporated multiple plies, typically combining either separate sheets in an aligned arrangement, or continuous or connected sheets that are accordion (or Z-) folded. These methods often include the aforementioned tab and perforation features. These approaches have disadvantages, too, in that to achieve the multiple ply construction, separate printing or aligning steps are required, thus increasing costs. Similarly, when multiple-layers with added adhesive are superimposed one on top of another for cut-sheet applications, such as those where single sheets are loaded into a printer cartridge, the greater thickness corresponding to the portions with adhesive produces an uneven, or leaning, stack. This can limit the number of sheets stackable into the printer cartridge, thereby necessitating increased operator oversight, with concomitant extra expense. Similar problems arise for packaging and refolding, as the increased volume and decreased symmetry make handling more cumbersome.

Consequently, what is needed is a tuck label that promotes low-cost fabrication techniques coupled with a secure, reliable device for accessing vital shipping information applicable to all forms of label stock, including roll, fan fold, continuous and cut sheet.

SUMMARY OF THE INVENTION

This need is met by the present invention wherein a tuck label without the disadvantages of the prior art is described. In accordance with one embodiment of the present invention, a tuck label with a substrate portion, a single, continuous piece label portion and at least one score line disposed within the label portion is described. The substrate portion further includes a release. surface disposed thereon. The label portion includes first and second faces, each of which can receive printable indicia thereon. Adhesive layers can be deployed at various places on the second face to facilitate removable adhesion between the label and substrate portions. This adhesion scheme may provide substantially full-perimeter closure capability of the label portion upon deployment onto the surface of a shipping package. The label portion outer boundaries are indicated by a plurality of top, bottom and side edges, with the side edges substantially perpendicular to the ones on the top and bottom. As used in conjunction with the present disclosure, the term "substantially" refers to an arrangement of elements or features that, while in theory would be expected to exhibit exact correspondence or behavior, may, in practice embody something slightly less than exact. The label portion is optionally defined by first and second orthogonal patterns, where the first orthogonal pattern runs generally parallel to the axis of the label portion being fed into a label printing device, while the second orthogonal pattern is coplanar with, but rotated 90° with respect to the first. Described as such, the structural makeup of the label portion is similar to most conventional paper products and related "two-dimensional" printable surfaces in that it includes a length dimension (first orthogonal pattern) and a width dimension (second orthogonal pattern). At least one fold line is located on the label, and extends parallel to the second orthogonal pattern to define adjacent print panels above and below the fold line.

The score line is broken up into a series of linearly-extending segments, and helps to divide up the label portion into various regions, including a mount region, a printable surface region and a pull tab region. The mount region occupies at least a part of the outer boundaries of the label, and constitutes the frame-like part of the label portion. Upon removal of the label portion from the substrate portion, the mount region can be fixedly attached to an article being labelled, such that once affixed, it typically becomes a permanent or semipermanent part of the article. To establish this permanent or semipermanent relationship, the mount region includes discrete amounts of the aforementioned adhesive layers disposed on its second face side. The printable surface region occupies a part of the label that is at least partially surrounded by the mount region, and includes the adjacent print panels that straddle the one or more fold lines discussed above. It is upon the adjacent print panels that the various forms of printed indicia commonly associated with the commercial shipping of goods can be placed, either by hand, or by conventional printing processes, such as laser, ink-jet and thermal transfer printing. The pull tab region is disposed between at least a part of the mount region and at least a part of the printable surface region, and is defined by parallel cut lines extending at least most of the length in the first orthogonal pattern direction of the adjacent print panels such that the cut lines are orthogonally intersected by the one or more fold lines. By extending away from both sides of the one or more fold lines, the parallel cut lines form one or more sets of upper and lower strips of a pull tab. At least one of each set of upper and lower strips includes a layer of adhesive. The adhesive layers disposed on the discrete parts of the second face of the label portion facilitate releasable adhesion between the label portion and the substrate portion. When the label portion is ready for use, and is removed from the substrate portion, it can then be folded along the one or more fold lines. This creates in the adjacent print panels a hinged, stacked arrangement. This also results in the one or more upper pull tab strips becoming adhesively bonded to and stackably aligned with the one or more lower pull tab strips, which in turn creates a multiple-ply reinforced pull tab from the single, continuous label. The resulting pull tab is more robust than a single-ply version, where the stacked alignment of the parallel cut lines of the upper and lower pull tab strips ensures a clean, even tear along the preferred path defined by the cut lines.

Optionally, when the label portion is made up of fibrous material, such as paper or paperlike products, the first and second orthogonal patterns can be substantially aligned in a with-grain and cross-grain direction, respectively. This results in a tuck label with grain orientations similar to that of conventional paper being fed into a conventional printer. The score line (and its associated score line segments) in the label portion of the tuck label can also be perforate, which helps it to be separated along preferred paths. To minimize the number of cuts made in the label portion, at least one of the perforate line segments in the mount region can be common with one of the parallel cut lines of the pull tab, as could one of the perforate line segments defining the printable surface region. Furthermore, the tuck label can optionally have adhesive disposed on at least a part of both surfaces of the second face corresponding to the pull tab region such that both the one or more upper pull tab strips and the one or more lower pull tab strips have adhesive backing. The parallel cut lines that define the pull tab region are preferably aligned substantially in the first orthogonal pattern direction. The width of the pull tab, defined by the parallel cut lines, can also be of specific dimensions, preferably between one eighth and three fourths of an inch wide. One or more sets of first and second starter cuts can be included in the pull tab such that, upon folding, the pull tab has an easily grippable end. This can be accomplished by having one of each set of first and second starter cuts disposed adjacent the printable surface region, while the other is disposed adjacent the mount region, and each of the first and second starter cuts are aligned with the parallel cut lines on the pull tab, with the first of the first and second starter cuts bisected by the fold line. Preferably, the length of the first of the first and second starter cuts is approximately one half inch long, with the length of the second of the first and second starter cuts approximately one quarter inch long. In addition, the second face corresponding to the first and second starter cuts of the pull tab can be free of any adhesive, thus fostering improved grippability and ease of removal features.

Additionally, the printable surface region can include adhesive on at least a part of its segment of the label portion's second face. Furthermore, there may be adhesive-free gaps extending linearly through one or more of the adhesive segments. These gaps may be spaced such that when a printer wheel or roller comes in contact with, and exerts pressure upon, the tuck label, it does so only on the gap so that pressure arising out of the contact is not transferred to any adhesive-containing portion. Other options may include having the mount region extend around at least three sides of the label portion to ensure thorough protection for the edges of the tuck label. The one or more fold lines can also be perforate. Furthermore, a centrally-disposed protruding section with a lower edge hounded by one of the one or more fold lines and upper edge defined by a score line can be included in the printable surface region of the label portion. This protruding section may include adhesive deposited on at least a part of its portion of the second face to permit the protruding section to be affixed to an article once the label portion has been removed from the substrate portion, folded, and placed on the article. In a preferred configuration, a layer of release material is placed on at least a part of the second face of the printable surface region of the label portion. This release material (such as silicone) could be placed on a part of the lower print panel such that it engages a layer of adhesive disposed on a mirror-image part of the upper print panel when the two panels are folded, one on top of the other, along the one or more fold lines. As an additional option, a substantially equivalent thickness of adhesive layer extends substantially around the entire periphery of the label portion to ensure that a stacked arrangement of a plurality of the tuck labels in their unfolded state exhibits substantially no stackwise unevenness, and further ensuring that all of the plurality of edges is securable to the article to be labelled. The former attribute is important in the storing of tuck labels prior to use, as well as upon arrangement in a conventional printer feeder tray, as, irrespective of feed orientation, no lean in even a large stack of labels is evident. The latter attribute is valuable for tuck labels that could otherwise become dislodged due to frictional and shear-like rubbing between adjacent surfaces with labels disposed thereon.

Moreover, the tuck labels of the present invention lend themselves to continuous roll production. Thus, numerous tuck labels can easily be fabricated from a continuous web of label and substrate stock. Cut-sheet forms (suitable for modem office printers, such as laser printers) can also be easily formed from a continuous web of stock, as can fan-folded forms suitable for continuous feed printers. In such cut-sheet configurations, each tuck label can be individually mounted to a single cut sheet each of which may then be subsequently stacked in a conventional paper tray of a printer device.

According to another embodiment of the present invention, a tuck label includes a label portion, a substrate portion and a series of perforate line segments disposed in the label portion. The label portion is from a single piece of label material, such as paper or paper-like printable material, and is defined by with-grain and cross-grain orthogonal patterns. At least the first face is printable, and at least the second face may have adhesive disposed on at least a part of its surface. The label portion is defined at the periphery by at least a top edge, a bottom edge, and a plurality of side edges substantially perpendicular to the top and bottom edges. The label portion further includes a substantially horizontal cross-grain fold line extending between at least two of the side edges, thereby dividing the printable first face into adjacent upper and lower print panels. The substrate portion is releasably adhered to the label portion through the adhesive. The series of perforate line segments help to define a plurality of regions, including a mount region, a printable surface region and a pull tab region. The mount region forms a frame-like part that occupies at least a part of the outer boundaries of the label portion, and includes the majority of adhesive disposed on the second face of the label portion, with at least part of the mount region having adhesive disposed on its second face side. The printable surface region includes the adjacent upper and lower print panels, while the pull tab region, which is disposed between at least a part of the mount region and at least a part of the printable surface region, is further defined by at least two with-grain perforate lines extending at least most of the with-grain length of the adjacent print panels such that the two with-grain perforate lines are substantially bisected by the cross-grain fold line, and are in substantially the first orthogonal pattern direction of the adjacent upper and lower print panels such that the with-grain perforate lines extend away from both sides of the fold line, thereby forming at least upper and lower pull tab strips. At least one of the strips includes adhesive disposed on at least a part of its second face such that, upon removal of the label portion from the substrate portion and subsequent folding of the label portion along the substantially horizontal fold line, a hinged, stacked arrangement of the adjacent upper and lower printable surfaces is created. The upper pull tab strip is adhesively bonded to and stackably aligned with the lower pull tab strip, thereby creating a multiple-ply reinforced pull tab from the single piece label portion.

According to still another embodiment of the invention, a method of using a tuck label with a reinforced pull tab is disclosed. The method includes removing a single piece label portion of the tuck label from a substrate portion, where the single piece label portion includes at least a mount region, a printable surface region and a pull tab region, all separated from one another by a series of score line segments, and wherein the pull tab region is further defined by at least two substantially parallel cut lines extending at least most of the length in the first orthogonal pattern direction of the printable surface region such that the substantially parallel cut lines are orthogonally intersected by a fold line disposed within the pull tab and printable surface regions; folding the label portion substantially along the fold line until at least a portion of the opposing label portion sides come into adhesive contact with one another, thereby causing the parallel cut lines of the upper pull tab strip to stackably align with those of the lower pull tab strip to form a multiple-ply pull tab from the single piece label portion; and adhesively applying the label portion to a surface of an article to be shipped.

Optionally, the method includes the additional step of printing indicia on at least a portion of the label portion prior to removing the label portion from the substrate portion. This additional printing step may be performed either manually or with the use of automated equipment, such as a label printing device. In the case of automated printing, the tuck labels can be fed either continuously, where the substrate portion is part of a large, continuous web, or individually, where the substrate is divided up into discrete cut sheets. Another step may include lifting a starter cut that has been disposed on the pull tab. Another optional step includes placing a layer of release material on one of the print panels such that the release material engages a layer of adhesive disposed on a mirror-image part of the upper print panel when the two panels are folded, one on top of the other, along the one or more fold lines. Similarly, other optional steps may comprise: grasping at least one end of the pull tab that has been folded over from the single sheet of label portion of a tuck label, wherein the pull tab has starter cuts to facilitate the grasping; removing the pull tab from between the adjacent mount and printable surface regions; grasping at least one edge of the printable surface region; and separating at least one of the printable surface panels by tearing at least one of the printable surface panels along predetermined perforation lines until it is no longer attached to the mount region. Another additional step may include printing indicia (either manually, or through an automated print mechanism, such as a laser printer) on the printable surface region of the label portion. Another step could include dividing up the tuck labels into individual cut sheets prior to removal of the single piece label portion, such that one label portion is adhesively affixed to one substrate portion, and that the individual cut sheets can be stacked in order to be more easily stored, transported or printed onto. The printing step may be further defined by sending the printable surface region to an automated print mechanism while the printable surface region is adhesively affixed to a continuous web of substrate portion.

Other objects of the present invention will be apparent in light of the description embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION

Figure 1A:
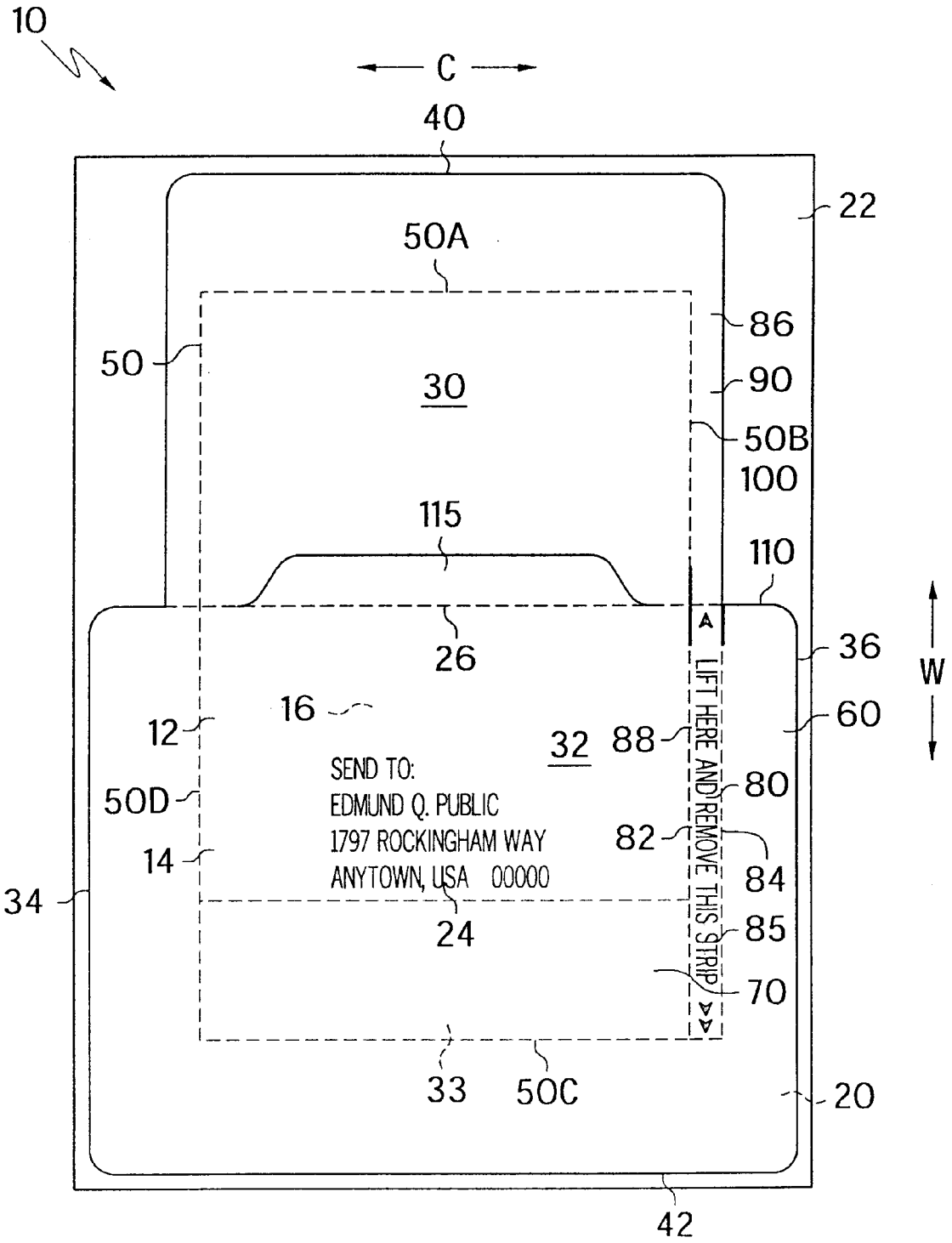
FIG. 1A is a surface view of a tuck label in its as-manufactured state, according an embodiment of the present invention.
Figure 1B:
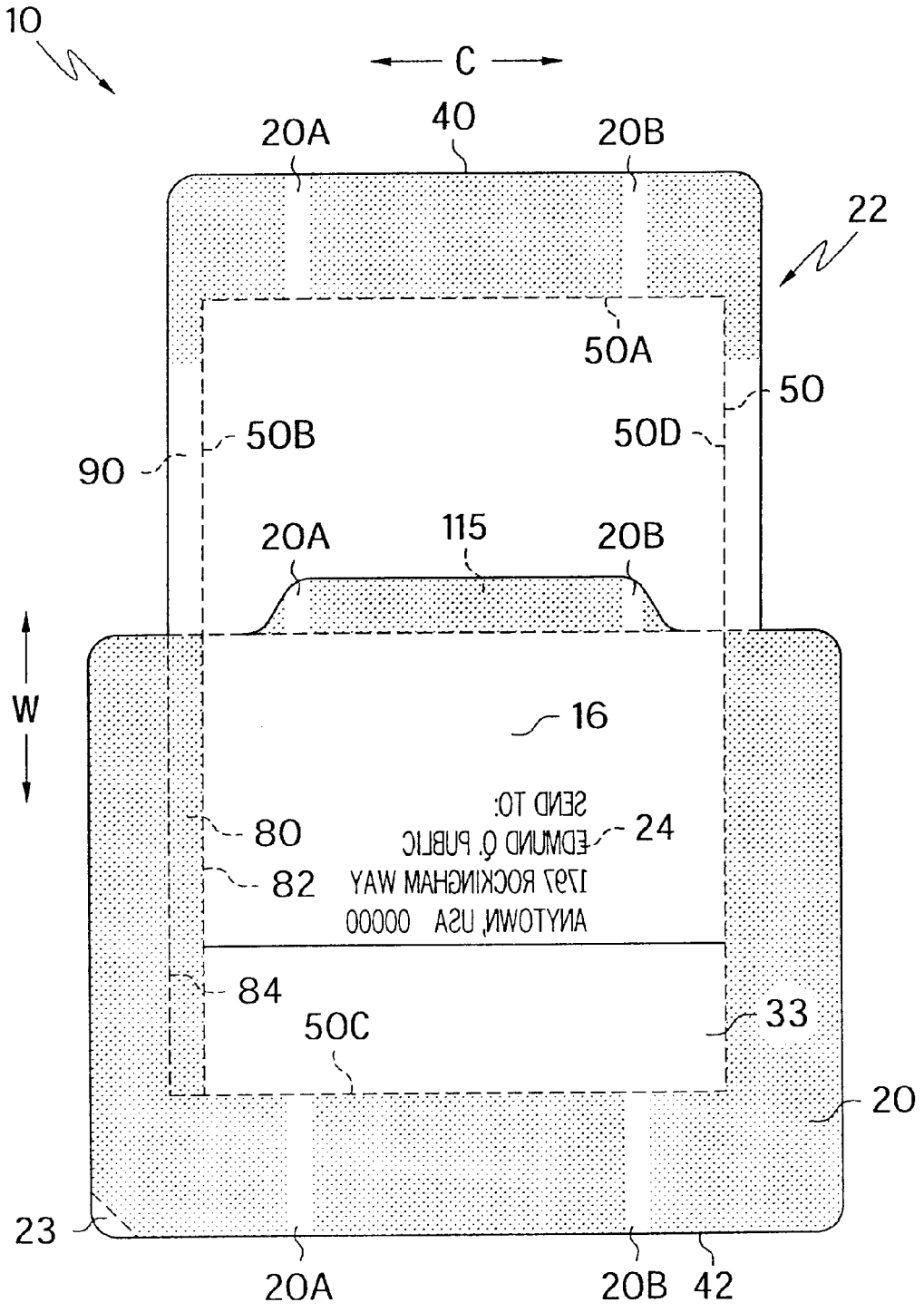
FIG. 1B is a surface view of the tuck label of FIG. 1A rotated 180° about the vertical axis, and with the substrate portion removed therefrom.

Referring first to FIGS. 1A and 1B, a tuck label 10 according to an embodiment of the present invention is shown. The tuck label 10 can be affixed to one or more surfaces of a shipping article (not shown), such as a package, box, carton, envelope, container and the like. Tuck label 10 includes a label portion 12 constructed from a planar sheet of foldable, printable material, such as paper, having opposing surfaces making up a first face 14 and a second face 16. Prior to folding, label portion 12 is substantially planar. Portions of at least one of the two faces are coated at discrete locations with a pressure-sensitive adhesive 20. To avoid contact between adhesive 20 and the wheels or rollers of a printer or tuck label transport device used during the tuck label print (not shown) or applicator process (not shown, but covered in co-pending application entitled "Apparatus and Method for In-line Folding and Affixing of Tuck Label", application Ser. No. 09/322,631 filed May 28, 1999, PA, which is owned by the Assignee of the present invention, and the disclosure of which is hereby incorporated by reference), adhesive-free gaps 20A, 20B may be included. These gaps are intermittently disposed along the feed direction of the label portion such that when the tuck label 10 crosses the path of a wheel disposed on such a device, the pressure arising out of that crossing is communicated only to that part of the tuck label 10 that is devoid of adhesive 20. Adhesive 20 facilitates both removable adhesion to a substrate portion 22, as well as more permanent adhesion to a goods-carrying container. In the present context, "removable adhesion" refers to temporary, partial adhesion between two adjoined surfaces, where at least one of the surfaces is relatively stick-free. An example of this arrangement is a silicone-coated piece of paper in contact with a pressure-sensitive adhesive strip on an adjoining surface. In contrast, terms implying "permanent" or "semipermanent" adhesion (used interchangeably herein) include situations where the adhesion between two adjoining surfaces is such that in the process of separating the surfaces, damage is done to either of them, or the adhesive properties of the adhesive are severely curtailed. Substrate portion 22 is preferably made of silicone-coated paper. Label portion 12 can be removed from substrate portion 22 an then applied to an article, such as a cardboard box, where it is permanently adhered. Optionally, one or more corners 23 of label portion 12 can be free of adhesive 20. This provides a corner that can be gripped to peel label portion 12 away from substrate portion 22. Either of the first or second faces 14 or 16, respectively, of tuck label 10 can also accept printed indicia 24 thereon. For example, the name and destination of the article's recipient can be printed anywhere on the first face 14, as shown in the figure.

Arrow W designates the orientation of a first orthogonal pattern of the label portion 12 of the tuck label 10, while arrow C designates the orientation of a second orthogonal pattern. In an embodiment where the label portion 12 is made of fibrous materials, such that said fibrous materials define a paper-like structure, the first orthogonal pattern W equates to a with-grain direction, and the second orthogonal pattern C equates to a cross-grain direction. First orthogonal pattern W also generally corresponds to the direction the tuck label 10 would be fed into a printer for placing printed indicia 24 on one or both faces 14, 16. One or more fold lines 26 extend substantially in the second orthogonal pattern C from one side edge 34 of label portion 12 to the opposing edge 36. The fold line 26 may include a crease, a dotted line, or a perforate line to facilitate a folding operation. Although the preferred embodiment described herein is with reference to a tuck label having a single fold line 26 that defines two adjacent print panels 30 (upper), 32 (lower) thereby, those of ordinary skill in the art will appreciate that both the apparatus and method of the present invention also contemplate having more than one fold line and a number of print panels. In situations where a single fold line 26 is utilized, the upper print panel 30 and the lower print panel 32 form substantially mirror-image structures (excepting the presence of a centrally disposed protruding section 115, described in more detail below). In the present context, "mirror-image" refers to tuck label structure that possesses similar features on opposing sides of a fold line such that when the tuck label is folded, the mirror-image features substantially face each other in an aligned relationship. Adhesive 20 can optionally be placed along side edges 34, 36, as well as along top and bottom edges 40, 42 of the second face 16 of label portion 12 such that, when the label portion 12 is folded along fold line 26, two adhesively bonded ply layers are formed. In addition, lower print panel 32 includes on a lower part of its portion of the second face 16 of label portion 12 a layer of release material 33, such as silicone. This may serve to releasably adhere the portion of lower print panel 32 with the release surface 33 to the portion of upper print panel 30 bounded above by top edge 40, and below by an upper score line segment 50A of score line 50.

The score line 50 cut into or through label portion 12 is used to facilitate easy removal of label portion 12 once affixed to a container surface, in addition to creating borders between various regions. In one embodiment, the score line is perforate, thus providing a balance between strength and tearability. The scoring of the line could be, in the alternative, in the form of a groove, also cut either all the way through or only into the first face 14 of label portion 12. A shown, score line 50 can comprise a series of segments, including an upper score line segment 50A, right side score line segment 50B, lower score line segment 50C and left side score line segment 50D arranged contiguously. It is appreciated by those skilled in the art that additional segments may be incorporated, depending on the configurational requirements of the label portion. For example, as will be discussed in more detail below, and as shown in the figure, additional laterally disposed, vertically extending score line segments can help to define a pull tab region. The series of contiguously placed score line segments 50A, 50B, 50C and 50D define one or more regions, including mount region 60, printable surface panel region 70, and pull tab region 80. The generally "U"-shaped mount region 60 at least partly surrounds the printable surface panel region 70, and is at least mostly coated with adhesive 20. As such, the mount region 60 defines a frame between which the printable surface panel region 70 of tuck label 10 fits. Mount region 60 is sized, shaped, and positioned such that, when the printable surface panel region 70 and pull tab region 80 are folded over, they reside within the frame-like border of mount region 60. In addition, pull tab region 80 and printable surface panel region 70, while both connected to the mount region 60 by virtue of the score line 50, are not adhesively affixed thereto. Pull tab region 80 includes cut lines 82 and 84 which extend along the length of printable surface panel 32 and most of the length of printable surface panel 30. To minimize production cost, as well as to improve structural efficiency, cut lines 82 and 84 are colinear with, and can comprise part of, one or more segments of score line 50. By way of example, right side score line segment 50B and cut line 82 are one and the same in their common region. Cut lines 82 and 84 are generally similar to score line 50, and can further be either a continuous groove cut or a perforation line. The orthogonal intersection of the pull tab region 80 by the fold 26 defines at least one pull tab upper strip 86 and at least one pull tab lower strip 88 which, when adhesively bonded together, make up laminated pull tab 90. As shown in FIG. 1A, either of the pull tab upper strip 86 or lower strip 88 may include printed indicia 85 thereon, such as directions for where to grasp and remove the pull tab 90. One of the chief attributes of the present invention is that by having multiple plies bonded together, the pull tab 90 is strengthened. Another important aspect is that by having the pull direction align with the first orthogonal pattern W of the paper, the pull tab 90 is more likely to tear smoothly, rather than in some uneven, uncontrolled fashion.

Figure 2:
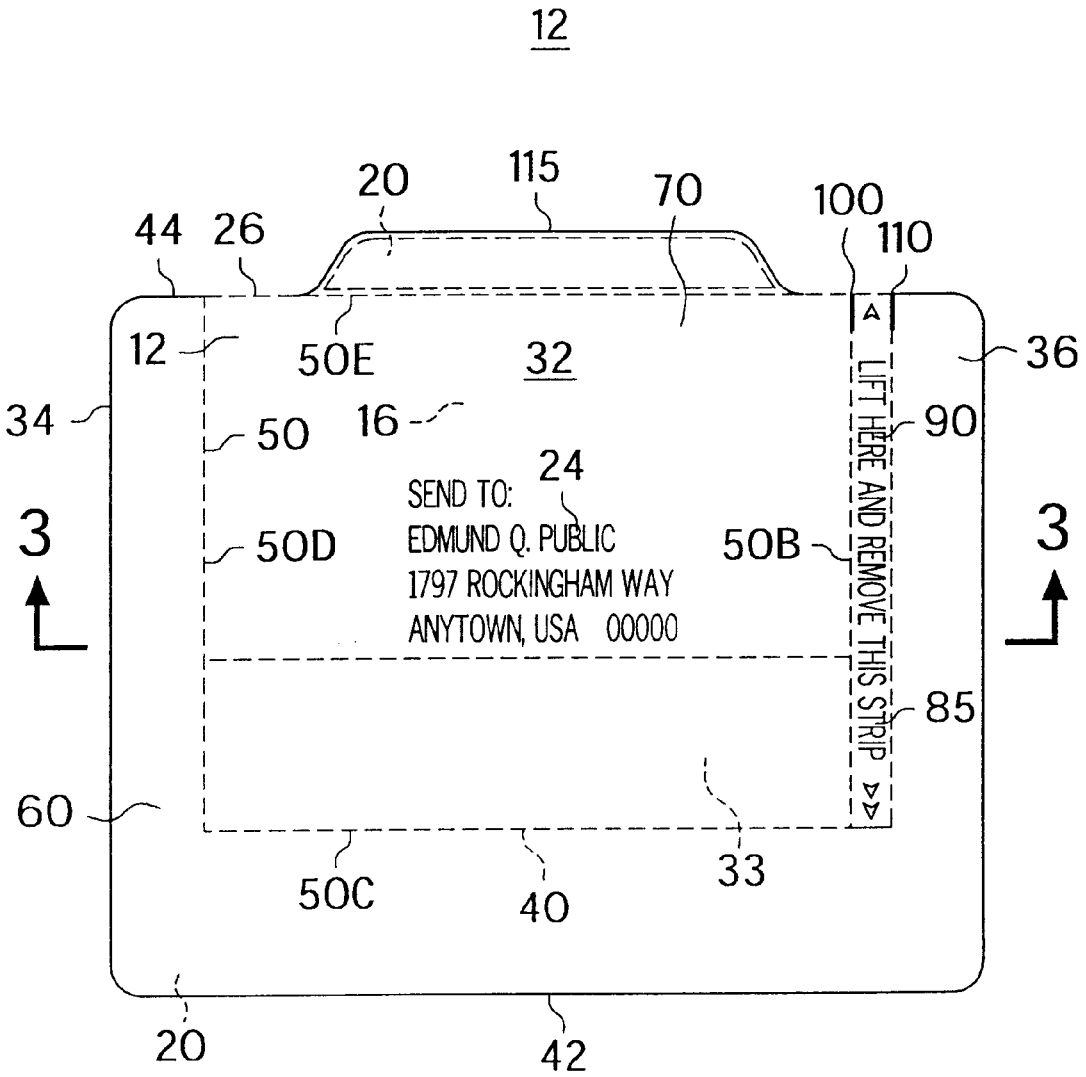
FIG. 2 is a surface view of a tuck label label portion after having been removed from its substrate portion and folded along a centrally-disposed fold line, according an embodiment of the present invention.

FIG. 2 depicts label portion 12 after it has been removed from substrate portion 22, folded over along fold line 26, and applied to a surface, such as an outer surface of a shipping container (not shown). In this configuration, print panel 30 (not shown in this figure) aligns with print panel 32, causing their respective portions of second face 16 to face each other. In this orientation, the label portion 12 is held in place by adhesive 20 on the second face 16 in region 60 and in a centrally disposed protruding section 115. Where adhesive-coated surfaces are bonded together, durable, strong laminate portions are produced, the most notable example of which is pull tab 90. It is especially important to have the upper print panel 30 (not shown) stackably align with lower print panel 32 to ensure that mirror-image counterparts of left and right side score line segments 50B, 50D are aligned, so that smooth, even tears are produced. Similarly, top edge 40 is stackably aligned with lower score line segment 50C. To make the pull tab easier to grasp, starter cuts 100 and 110 are provided in line with pull tab perforations near one of the two ends. At least one of the starter cuts 100 (as notionally shown in FIGS. 1 and 2) can be of longer length than the balance of the perforations, and is bisected by fold line 26. Thus, upon the folding together of panels 30 (not shown) and 32, starter cut 100 facilitates the separation of pull tab 90 from the label portion 12. Additional printed indicia 85 can be added to one of the pull tab 90 upper or lower strips 86 or 88, respectively. Such indicia can provide removal instructions, for example.

To enhance foldability of upper adjacent print panel 30 onto lower adjacent print panel 32, a transverse score line segment 50E of score line 50 is placed colinear with fold line 26. To remove the printable surface panel region 70, the pull tab 90 is first torn away. Then, the recipient manually tears panels 30 (not shown) and 32 along the score line segments 50C and 50D. The placement of the score line 50, as well as adhesive 20 at discrete locations also permits a substantially "full-perimeter" closure of tuck label 10. In situations where the label portion 12 is mounted to the surface of a package that is stacked with other packages, or where the surface bearing the label portion 12 can be expected to be rubbed against another surface, it has been found to be advantageous to secure the label portion 12 on all sides, providing optimum resistance to being snagged or otherwise peeled off during such relative movement. To that end, centrally-disposed protruding section 115 is integral with lower adjacent print panel 32, and extends between it and upper adjacent print panel 30 (not shown). Adhesive 20 is placed on the second face 16 of protruding section 115 to adhesively affix at least a part of folded top edge 44 of print panel 32 to an article surface.

Figure 3:
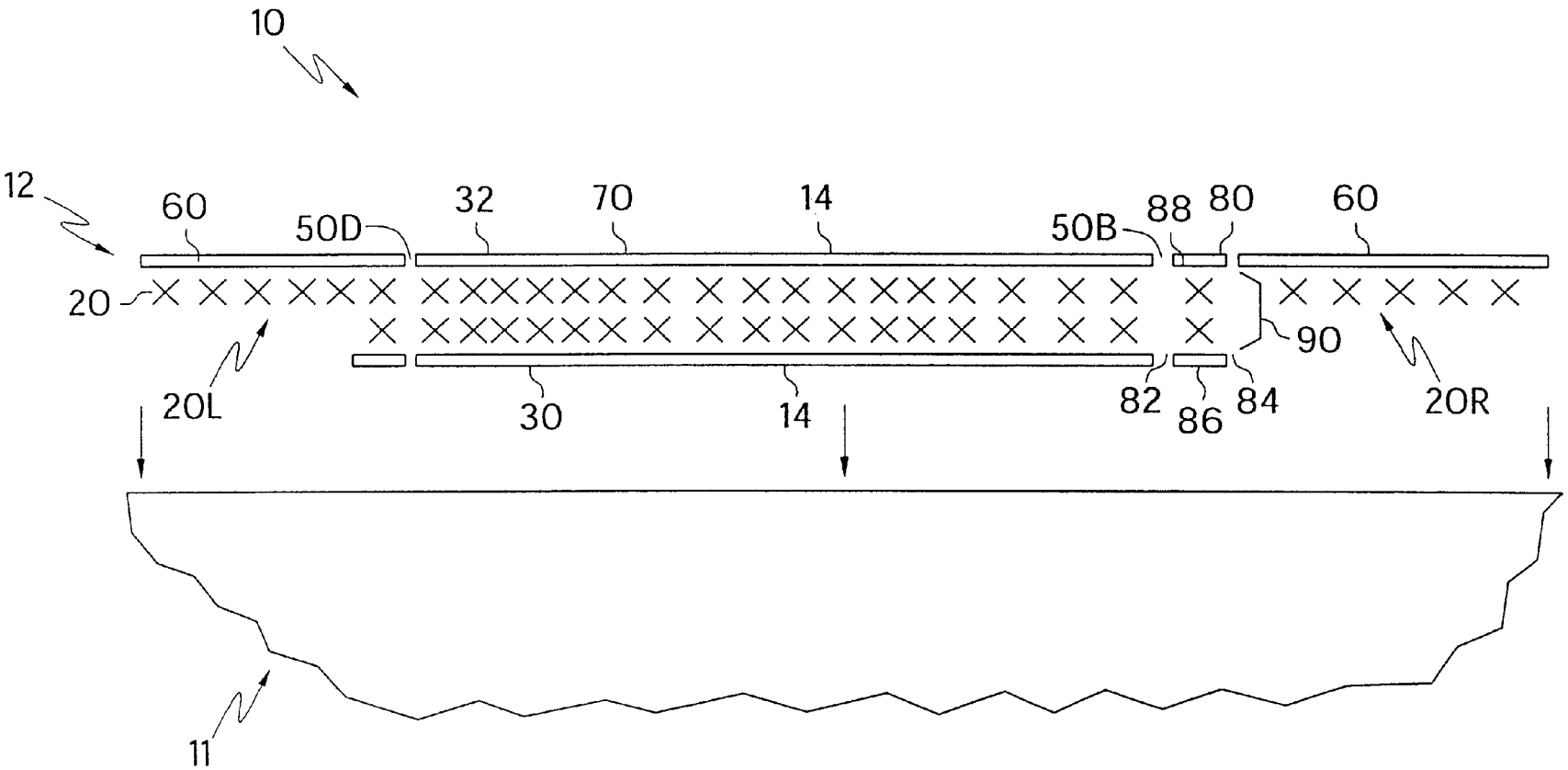
FIG. 3 is a sectional view of the tuck label label portion taken along lines 3—3 of FIG. 2.

Referring now to FIG. 3, an edge-on sectional view of the folded-over configuration of FIG. 2 shows the tuck label 10 with the substrate portion removed, thereby exposing adhesive 20. Left and right side score line segments 50B and 50D, as well as cut lines 82, 84 are shown exaggerated to enhance figure clarity. Upper adjacent printable surface panel 30 is folded about fold line 26 (not shown in the present figure), and placed underneath lower adjacent printable surface panel 32. When the label portion 12 of tuck label 10 is affixed to article 11, a portion of first face 14 of label portion 12 non-adhesively contacts the surface of article 11. Adhesive 20L and 20R, in conjunction with adhesive 20 on protruding section 115 (shown in FIG. 2), permanently affixes label portion 12 to article 11. Upper and lower pull tab strips 86 and 88 of pull tab 90 are adhesively bonded to one another by adhesive 20, which may extend around the substantially entire periphery of the adjacent print panels 30, 32. This promotes a relatively even thickness across all parts of the label portion 12 that are designed to be separated from mount region 60.

Figure 4:
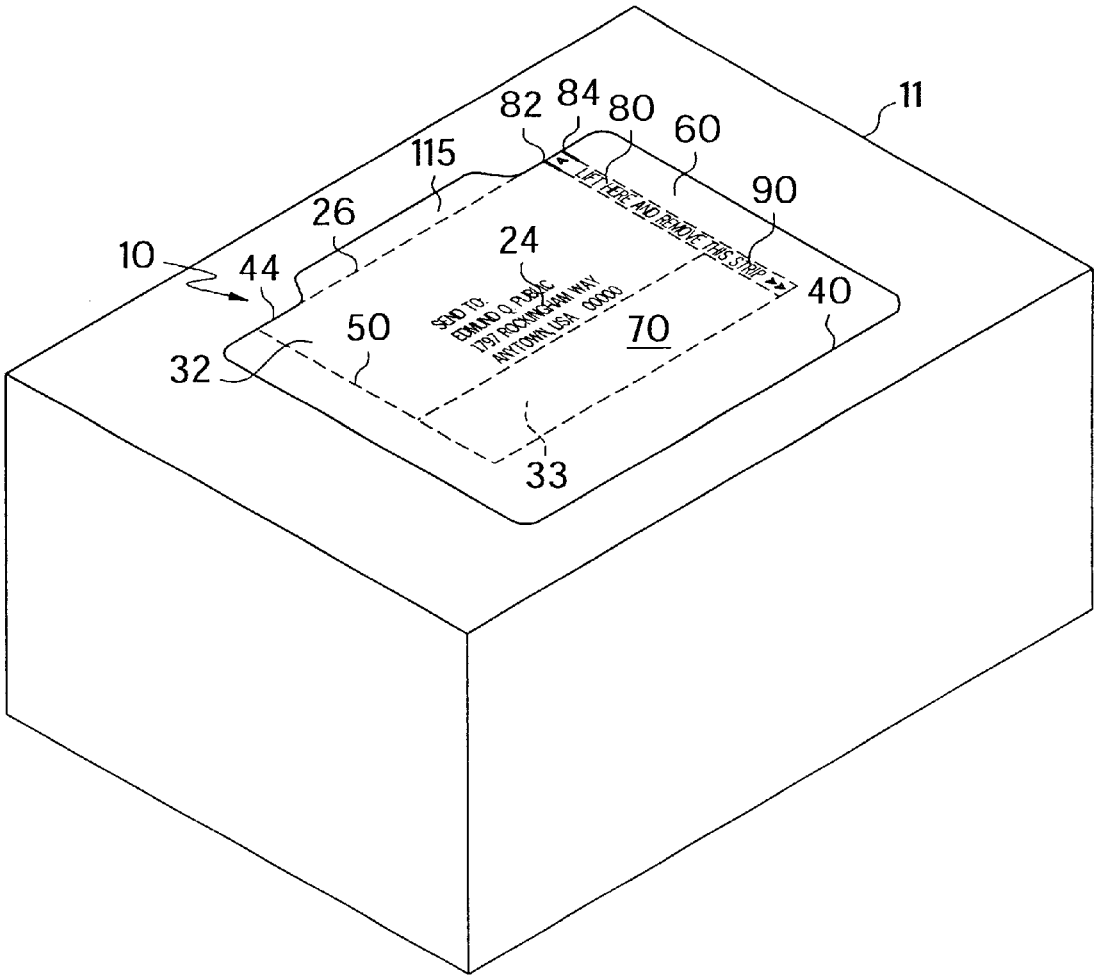
FIG. 4 is a perspective view of a folded tuck label deployed on the surface of an article to be shipped.
Figure 5:
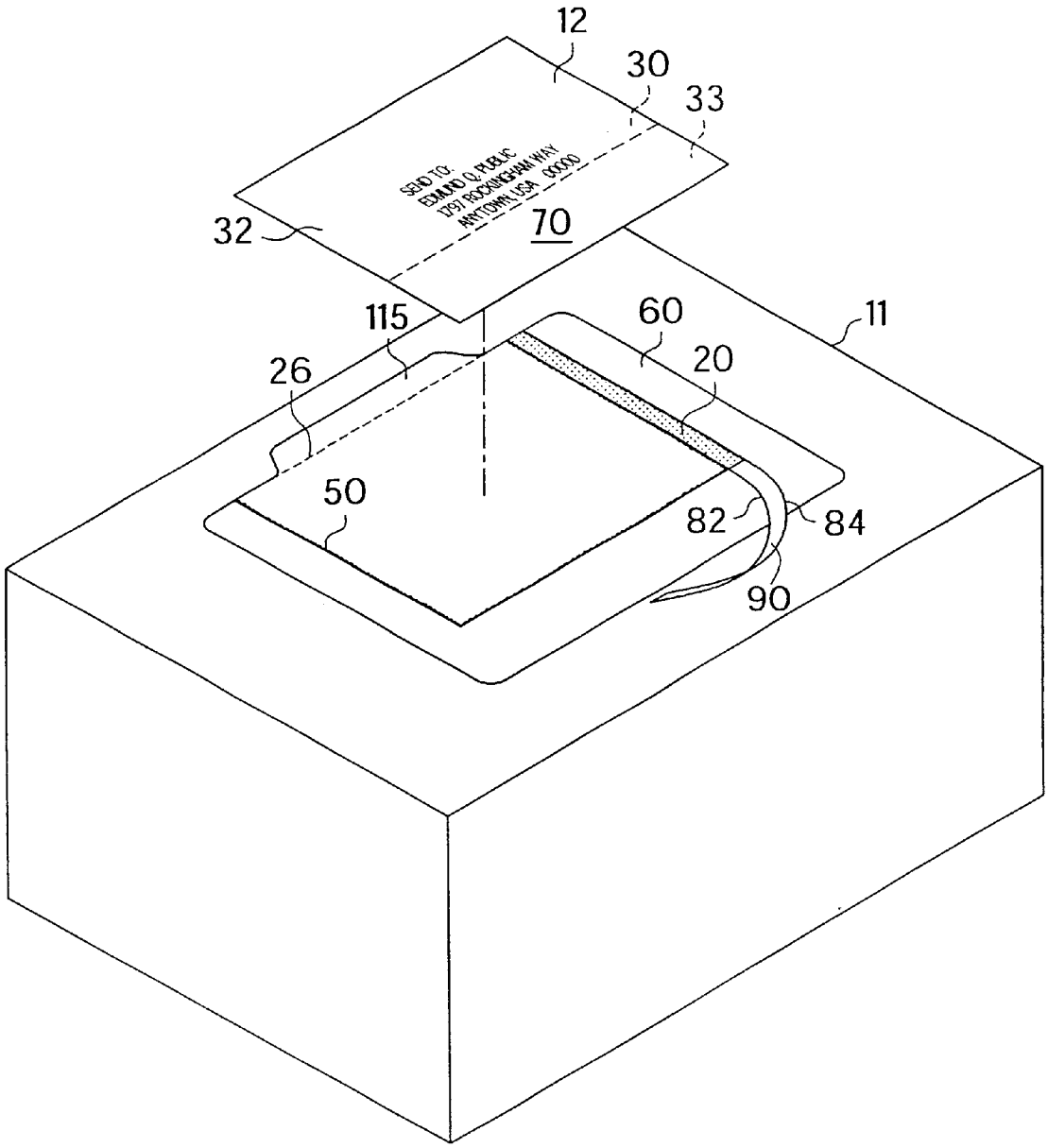
FIG. 5 is a perspective view of the printable surface region of the tuck label of FIG. 4 after separation from the tuck label mount region.

As shown in FIGS. 4 and 5, the label portion 12 of tuck label 10 is shown first affixed to (FIG. 4), then the printable surface region 70 removed from (FIG. 5), the surface of article 11. The score line 50 permits the deployed label portion 12 to be separated from the mount region 60. Note that, with the exception of protruding section 115, the printable surface region 70 is not adhesively affixed to the article 11. Nonetheless, printable surface region 70 establishes an affixed relationship between it, pull tab region 80 and mount region 60 due to the perforate connections of score line 50 and parallel cut lines 82, 84. With specific reference to FIG. 5, by tearing the pull tab 90 along its parallel cut lines 82 and 84, then tearing the label portion 12 along the segments of score line 50 extending along its remaining sides, label portion 12 separates from the mount region 60 and protruding section 115, thereby permitting removal of the adjacent print panels 30 and 32, thus providing ready access to shipping or related information printed thereon.

Figure 6A:
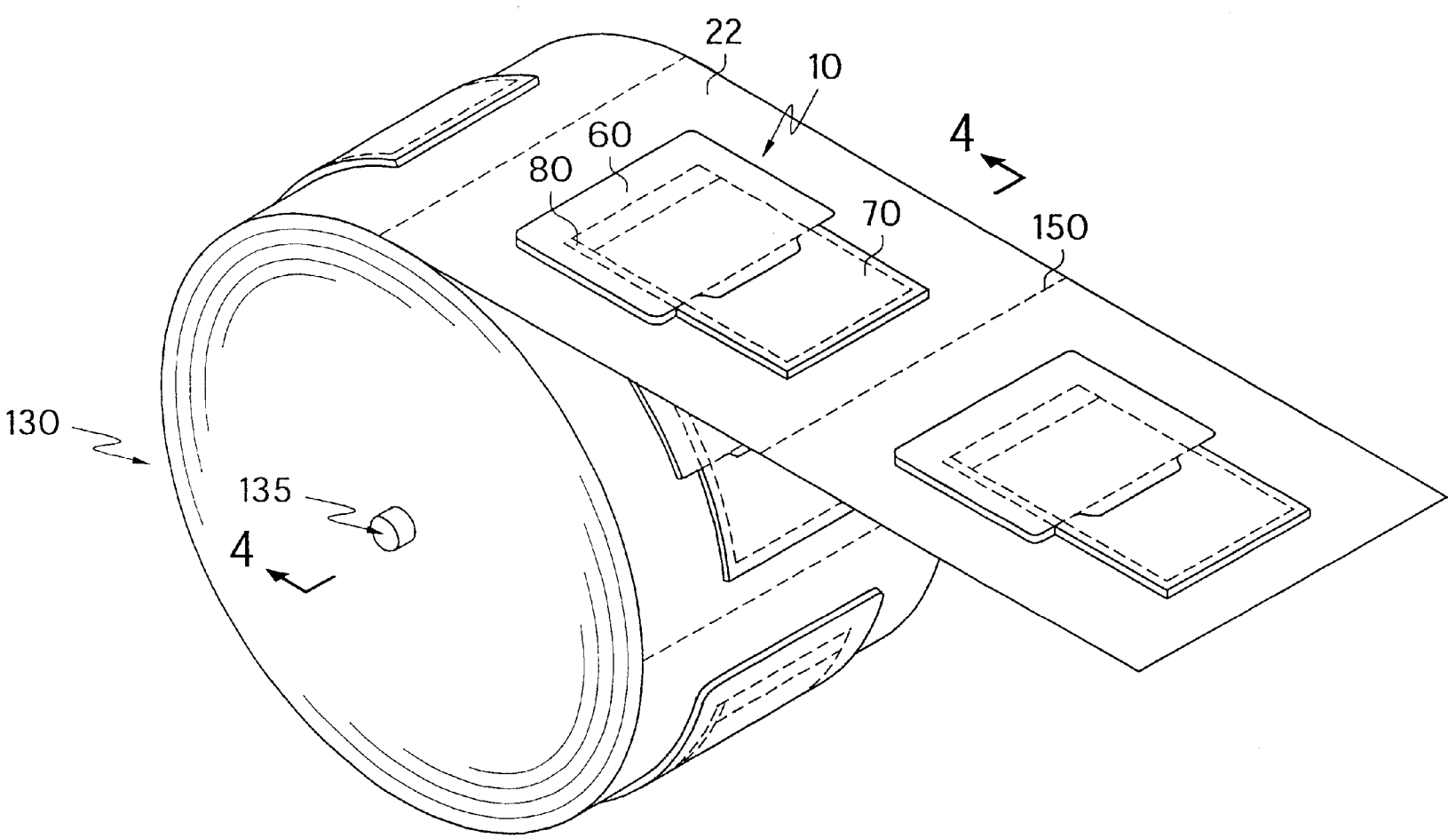
FIG. 6A is a perspective view of a continuous roll of tuck labels according to an embodiment of the present invention.
Figure 6C:
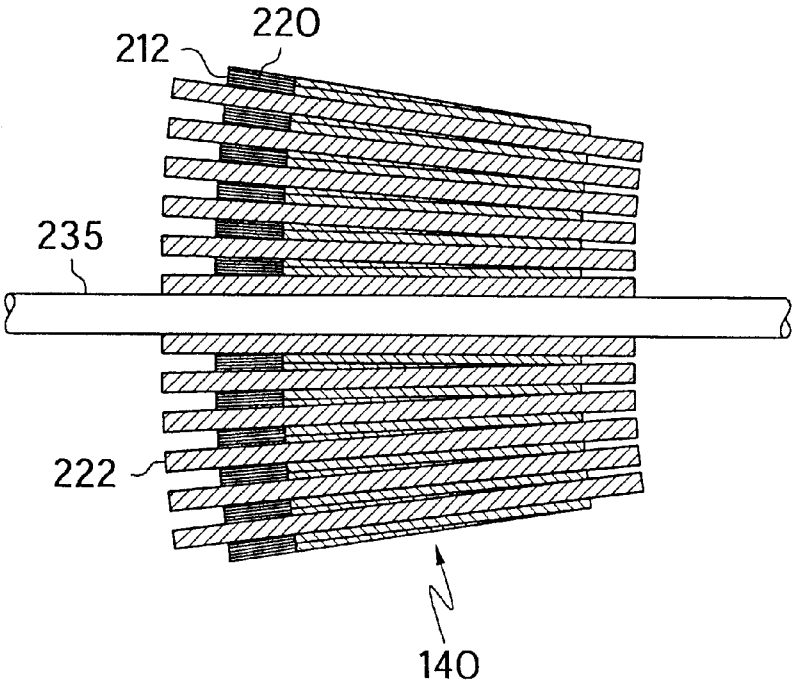
FIG. 6C is a sectional view similar to FIG. 6B, illustrating a continuous roll of tuck labels according to the prior art.
Figure 6B:
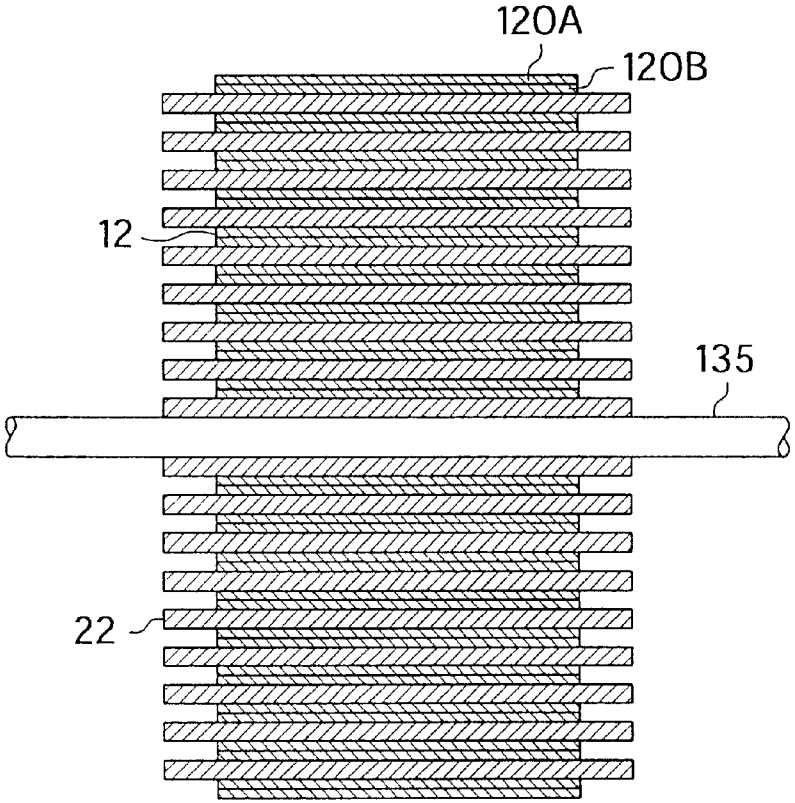
FIG. 6B is a sectional view taken along lines 4—4 of FIG. 6A.

Referring now to FIGS. 6A–6C, with particular emphasis on FIGS. 6A and 6B, a continuous roll (or web) 130 of substrate 22 containing a plurality of label portions 12 is shown. Score lines 150 can optionally be included to permit easy separation of individual tuck labels 10 into stackable sheets. The score lines 150 may be similar in configuration to those used on label portion 12, as previously described. The utility of having even adhesive thickness disposed around substantially the entire periphery of the printable surface region 70 and the pull tab region 80 can be more readily appreciated when the myriad layers of sheets required to make up roll 130 are viewed in conjunction with the sectional views shown in FIGS. 6B and 6C, taken along cut line 4—4 in FIG. 6A. Under the teaching of the present invention, as shown in FIG. 6B, the substantially "full-perimeter" approach of the two adjoining adhesive layers 120A and 120B ensures even stacking of the label portion 12 and substrate portion 22 layers about central spindle 135. In contrast, FIG. 6C shows that under an asymmetric application of adhesive 220 as practiced in the prior art, an uneven or leaning stack of label portions 12 and substrate portions 22 is produced. This would convert the generally cylindrical roll 130 of FIG. 6B into a frustroconical shape 140, as shown in FIG. 6C, with attendant stacking and storage difficulties. Note that this leaning stack is formed in both the continuous web of FIG. 6B, as well as in the stacked cut sheet configuration (not shown).

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A tuck label for attaching to an article to be labelled, said tuck label comprising:

a substrate portion comprising a release surface;

a single, continuous piece label portion disposed upon said substrate portion and adapted to receive printable indicia thereon, said label portion including:

first and second faces;

a plurality of edges defining a periphery, said plurality of edges including at least top and bottom edges and at least one pair of side edges substantially perpendicular to said top and bottom edges; and at least one fold line extending between said side edges to define adjacent print panels on said first face; and at least one score line disposed within said label portion, said at least one score line defining a plurality of regions, including:

a mount region occupying at least a part of the outer boundaries of said label portion, with adhesive disposed on at least a part of said second face of said label portion in said mount region;

a printable surface region, at least partially surrounded by said mount region, said printable surface region including at least a part of said adjacent print panels; and a pull tab region disposed between at least a part of said mount region and at least a part of said printable surface region, said pull tab region further defined by parallel cut lines extending at least a majority of the length of said adjacent print panels such that said parallel cut lines are orthogonally intersected by said at least one fold line, thereby forming at least upper and lower pull tab strips at least one of which includes adhesive disposed on at least a part of said second face of said label portion in said pull tab region, wherein said adhesive facilitates releasable adhesion between said label portion and said substrate portion, such that, upon removal of said label portion from said substrate portion and subsequent folding of said label portion along said at least one fold line, said adjacent print panels exhibit a hinged, stacked arrangement, and said upper pull tab strip is adhesively bonded to and aligned with said lower pull tab strip, thereby creating a multiple-ply reinforced pull tab from said single, continuous label portion.

2. The tuck label of claim 1, wherein said label portion is further defined by first and second orthogonal patterns, such that said first orthogonal pattern extends substantially between said top and bottom edges, said second orthogonal pattern extends substantially between said at least one pair of side edges, and said parallel cut lines extend in substantially the same direction as said first orthogonal pattern.

3. The tuck label of claim 2, wherein said first orthogonal pattern is substantially aligned in a with-grain direction that extends between said top and bottom edges, and said second orthogonal pattern is substantially aligned in a cross-grain direction that extends between said side edges.

4. The tuck label of claim 1, wherein said at least one score line is perforate, and at least one of said parallel cut lines are perforate.

5. The tuck label of claim 4, wherein at least a part of said at least one perforate line defining said mount region is common with one of said perforate parallel cut lines of said pull tab.

6. The tuck label of claim 5, wherein at least a part of said at least one perforate line defining said printable surface region is common with one of said perforate parallel cut lines of said pull tab.

7. The tuck label of claim 1, wherein both of said upper pull tab strip and said lower pull tab strip have adhesive disposed on at least a part of said second face defined by said pull tab region.

8. The tuck label of claim 1, wherein said parallel cut lines of said pull tab are spaced between one eighth and three fourths of an inch apart.

9. The tuck label of claim 1, wherein said pull tab region further includes a first and second starter cut, with one of said first and second starter cuts disposed adjacent said printable surface region while the other of said first and second starter cuts is disposed adjacent said mount region, each of said first and second starter cuts aligned with said parallel cut lines on said pull tab.

10. The tuck label of claim 9, wherein said first of said first and second starter cuts is bisected by said fold line.

11. The tuck label of claim 10, wherein the length of said first of said first and second starter cuts is approximately one half inch long.

12. The tuck label of claim 11, wherein the length of said second of said first and second starter cuts is approximately one quarter inch long.

13. The tuck label of claim 10, wherein said second face of said label portion adjacent said first and second starter cuts of said pull tab region is free of any adhesive.

14. The tuck label of claim 1, wherein at least a part of said second face of said printable surface region includes adhesive disposed thereon.

15. The tuck label of claim 14, further comprising a plurality of gaps in said adhesive, said gaps spaced apart from one another and adapted to define at least one region of contact between said tuck label and at least one wheel used to transport said tuck label during a printing or applicator process such that pressure arising out of said contact is not transferred to any part of said tuck label containing said adhesive during any part of said printing or applicator process.

16. The tuck label of claim 1, wherein said mount region extends around at least three sides of said label portion.

17. The tuck label of claim 1, wherein said fold line is perforate.

18. The tuck label of claim 1, further including a centrally-disposed protruding section with a lower edge thereof bounded by said fold line, an upper edge defined by a score line, and adhesive applied to at least a part of said second face of said label portion in said protruding section.

19. The tuck label of claim 1, further comprising a layer of release material disposed on at least a part of said second face of said label portion, said layer of release material adapted to releasably adhere to a portion of said adhesive disposed on a mirror-image across said fold line of said second face of said label portion.

20. The tuck label of claim 1, wherein a substantially equivalent thickness of adhesive layer extends substantially around the entire periphery of said label portion, thereby ensuring that a stacked arrangement of a plurality of said tuck labels in their unfolded state exhibits substantially no stackwise unevenness, and further ensuring that all of said plurality of edges are adapted to be securable to said article to be labelled.

21. The tuck label of claim 1, wherein said tuck labels are individually disposed on cut sheets.

22. A tuck label comprising:

a single piece label portion defined by a cross-grain pattern and a with-grain pattern, said label portion with a printable first face and a second face with adhesive disposed on at least a part of said second face, said label portion defined at the periphery by at least a top edge, a bottom edge, and a plurality of side edges substantially perpendicular to said top and bottom edges, said label portion further defined by a substantially horizontal cross-grain fold line extending between at least two of said plurality of side edges, said fold line dividing said printable first face into adjacent upper and lower print panels;

a substrate portion releasably adhered to said label portion through said adhesive; and a series of contiguous perforate line segments disposed in said label portion, said series including:

a plurality of substantially horizontal perforate line segments; and a plurality of substantially vertically perforate line segments, wherein said series of contiguous perforate line segments define a plurality of regions, including:

a mount region occupying at least a part of the outer boundaries of said label portion, said mount region including adhesive disposed on at least a part of said second face;

a printable surface region at least partially surrounded by said mount region, said printable surface region including at least said adjacent upper and lower print panels; and a pull tab region disposed between at least a part of said mount region and at least a part of said printable surface region, said pull tab region further defined by at least two with-grain perforate lines extending at least a majority of the with-grain length of said adjacent print panels of said printable surface region such that said at least two with-grain perforate lines are bisected by said cross-grain fold line, thereby forming at least upper and lower pull tab strips at least one of which includes adhesive disposed on at least a part of said second face corresponding to said pull tab region such that, upon removal of said label portion from said substrate portion and subsequent folding of said label portion along said substantially horizontal cross-grain fold line, said adjacent print panels exhibit a hinged, stacked arrangement, and said upper pull tab strip is adhesively bonded to and stackably aligned with said lower pull tab strip, thereby creating a multiple-ply reinforced pull tab from said single piece label portion.

23. A method of using a tuck label with a reinforced pull tab, said method comprising:

removing a single piece label portion of said tuck label from a substrate portion, where said single piece label portion includes at least a mount region, a printable surface region and a pull tab region, all separated from one another by a series of score lines, and wherein said pull tab region is further defined by at least two substantially parallel cut lines extending at least a majority of the length of said printable surface region such that said cut lines are bisected by a fold line disposed within said pull tab region and said printable surface region;

folding said label portion substantially along said fold line until at least a portion of opposing sides of said label portion come into adhesive contact with one another, thereby causing said at least two cut lines of said upper pull tab strip to stackably align with said at least two cut lines of lower pull tab strip, thereby forming a multiple-ply pull tab from said single piece label portion; and adhesively applying said label portion to a surface of an article to be shipped.

24. A method according to claim 23, comprising the additional step of printing indicia on at least a portion of said label portion prior to removing said label portion from said substrate portion.

25. A method according to claim 23, comprising the additional step of lifting a starter cut that has been disposed on said pull tab.

26. A method according to claim 23, comprising the additional step of placing a layer of release material on at least a portion of a rear face of said printable surface region prior to said folding said label portion substantially along said fold line such that an edge defining a closest portion of said layer of release material to said fold line is spaced substantially the same distance from, but on mirror-image opposite sides of, said fold line as an edge defining a closest portion of a layer of adhesive.

27. A method according to claim 23, comprising the additional steps of:

grasping at least one end of said pull tab that has been folded over from a single sheet of label portion of a tuck label, wherein said pull tab has starter cuts to facilitate said grasping;

removing the pull tab from between said adjacent mount region and said adjacent printable surface region;

grasping at least one edge of said printable surface region of said label portion; and separating at least one of said printable surface regions by tearing said at least one of said printable surface regions along predetermined perforation lines until said at least one of said printable surface regions is no longer attached to said mount region.

28. A method according to claim 23, comprising the additional step of printing indicia on said printable surface region.

29. A method according to claim 28, wherein prior to removing said single piece label portion from said substrate portion, said tuck labels are divided up into individual cut sheets.

30. A method according to claim 28, wherein said label portion is sent to a print mechanism while still adhesively affixed to a continuous web of substrate portion.

* * * * *

UNITED STATES PATENT AND TRADEMARK OFFICE

CERTIFICATE OF CORRECTION

PATENT NO. : 6,394,500 B1
DATED : May 28, 2002
INVENTOR(S) : Nixon et al.

It is certified that error appears in the above-identified patent and that said Letters Patent is hereby corrected as shown below:

Column 2,
Line 19, reads "release. surface" should read -- release surface --

Column 4,
Line 10, reads "lower edge hounded by" should read -- lower edge bounded by --
Line 43, reads "modem office printers" should read -- modern office printers --

Column 7,
Line 7, reads "1999, PA, which is owned" should read -- 1999, Attorney Docket STD 0921 PA, which is owned --

Signed and Sealed this

Eighth Day of October, 2002

*Attest:*

*Attesting Officer*

JAMES E. ROGAN
*Director of the United States Patent and Trademark Office*